US007187883B2

(12) United States Patent
Sato

(10) Patent No.: US 7,187,883 B2
(45) Date of Patent: Mar. 6, 2007

(54) IMAGE FORMING APPARATUS HAVING FIXING DEVICE WITH COOLING DEVICE

(75) Inventor: Toshiki Sato, Tokyo (JP)

(73) Assignee: Oki Data Corporation, Tokyo (JP)

( * ) Notice: Subject to any disclaimer, the term of this patent is extended or adjusted under 35 U.S.C. 154(b) by 0 days.

(21) Appl. No.: 11/283,904

(22) Filed: Nov. 22, 2005

(65) Prior Publication Data

US 2006/0127119 A1 Jun. 15, 2006

(30) Foreign Application Priority Data

Dec. 14, 2004 (JP) ..... 2004-361950

(51) Int. Cl.
*G03G 15/20* (2006.01)

(52) U.S. Cl. ..... 399/69; 399/122; 399/320; 399/328; 399/330

(58) Field of Classification Search ..... 399/69, 399/67, 33, 122, 320, 328, 330
See application file for complete search history.

(56) References Cited

U.S. PATENT DOCUMENTS

| | | | | |
|---|---|---|---|---|
| 4,839,698 | A * | 6/1989 | Inuzuka et al. | 399/9 |
| 5,915,146 | A * | 6/1999 | Kusaka et al. | 399/68 |
| 2002/0118982 | A1 * | 8/2002 | Fuma | 399/329 |
| 2004/0190925 | A1 * | 9/2004 | Baruch et al. | 399/69 |

* cited by examiner

*Primary Examiner*—David M. Gray
*Assistant Examiner*—Geoffrey T Evans
(74) *Attorney, Agent, or Firm*—Takeuchi & Kubotera, LLP

(57) ABSTRACT

An image forming apparatus includes a fixing device for fixing developer on a recording medium; a heating device for heating the fixing device; a cooling device for cooling the fixing device; a temperature detecting device for detecting a temperature of the fixing device; a heating device control unit for controlling drive of the heating device; and a cooling device control unit for controlling drive of the cooling device. After the fixing device fixes the developer on the recording medium, when the temperature detecting device detects the temperature of the fixing device below a first temperature, the cooling device control unit reduces cooling effect of the cooling device.

24 Claims, 16 Drawing Sheets

| Time | Deceleration level | Acceleration level |
|---|---|---|
| t0~t1 | 2 | 2 |
| t1~t2 | 2 | 2 |
| t2~t3 | 1 | 1 |
| t3~t4 | 1 | 1 |
| t5~t6 | 1 | 1 |
| t6~t7 | 1 | 1 |
| t7~t8 | 1 | 1 |

Fig. 15

IMAGE FORMING APPARATUS HAVING FIXING DEVICE WITH COOLING DEVICE

BACKGROUND OF THE INVENTION AND RELATED ART STATEMENT

The present invention relates to an image forming apparatus such as an electric-photo printer, a copier, and a facsimile. In particular, the present invention relates to a fixing device of the image forming apparatus.

In a conventional image forming apparatus such as an electric-photo printer, a copier, and a facsimile, a fixing device heats developer transferred to a recording medium to melt, and presses the developer with a specific pressure to fix the same on the recording medium (refer to Patent Reference 1). The fixing device is provided with a heat source for supplying heat necessary for the fixing process. The heat source is controlled to have a temperature within a specific temperature range at which the fixing device can fix the developer.

Within the specific temperature range, developer or toner suitable for the recording medium can be properly fixed. At a temperature below the specific temperature range, it is difficult to adequately melt the toner. As a result, the toner is stuck to the recording medium with a strength less than a desirable level, and the toner may be stuck to a fixing roller, not the recording medium, a phenomenon called cold off-set. To the contrary, when a temperature exceeds the specific temperature range, the toner has a viscosity lower than a desirable level. As a result, the toner tends to adhere to the fixing roller, not the recording medium, a phenomenon called hot off-set.

The specific temperature range depends on a type of recording medium or a thickness thereof, and is typically stored as a table of set temperatures corresponding to a type of recording medium and a thickness thereof.

When an image forming apparatus starts printing, a temperature sensor disposed on a fixing device detects a temperature of the fixing device, so that it is determined that the fixing device is within a specific printable temperature range. When the temperature of the fixing device is below the specific printable temperature range, a target temperature suitable for a recording medium to be printed is set. Then, a heater of the fixing device is turned on. After the temperature of the fixing device becomes within the specific printable temperature range, a target temperature suitable for a recording medium to be printed is set without waiting for the fixing device to warm up. Then, the heater of the fixing device is turned on, and the image forming apparatus starts printing.

When the temperature of the fixing device is above the specific printable temperature range, a target temperature suitable for a recording medium to be printed is set without turning on the heater. After the fixing device is cooled down to the specific printable temperature range, the image forming apparatus starts printing.

Patent Reference 1: Japanese Patent Publication No. 10-104990

A target temperature is set, in general, such that the fixing device is heated up to a high temperature as possible, since it is sometimes difficult to predict the number of media. Accordingly, it is possible to prevent the fixing device from cooling down below the specific printable temperature range when a large number of media pass through the fixing device. However, when a target temperature is set such that the fixing device is heated up at a high temperature as possible, and only a small number of media pass through the fixing device, the fixing device is not cooled down. In an extreme case, the fixing device may be heated up above the specific printable temperature range, a phenomenon called over-shoot.

In this case, after a heater and a fixing motor are turned on, the fixing device fixes toner on a recording medium. Then, the recording medium is discharged, and the heater and the fixing motor are turned off. At this moment, the fixing device may be suddenly heated up above the specific printable temperature range, thereby causing the over-shoot. Once the over-shoot occurs, it is necessary to wait until the fixing device is cooled down into the specific printable temperature range.

On the other hand, when too many media are printed, the fixing device is cooled down below the specific printable temperature range, a phenomenon called under-shoot. Once the under-shoot occurs, it is necessary to wait until the fixing device is heated into the specific printable temperature range.

In view of the problems described above, an object of the present invention is to provide an image forming apparatus, in which it is possible to prevent the over-shoot or under-shoot from occurring.

Further objects and advantages of the invention will be apparent from the following description of the invention.

SUMMARY OF THE INVENTION

In order to attain the objects described above, according to the present invention, an image forming apparatus includes a fixing device for fixing developer on a recording medium; a heating device for heating the fixing device; a cooling device for cooling the fixing device; a temperature detecting device for detecting a temperature of the fixing device; a heating device control unit for controlling drive of the heating device; and a cooling device control unit for controlling drive of the cooling device. After the fixing device fixes the developer on the recording medium, when the temperature detecting device detects the temperature of the fixing device below a first temperature, the cooling device control unit controls the cooling device to reduce cooling effect of the cooling device.

In the invention, after an image forming device forms an image, the cooling device is operated to cool the fixing device. The first temperature is set at a temperature with a specific increment from a lower limit of a printable temperature range per a specific period of time. Accordingly, the cooling device is controlled, so that the temperature of the fixing device gradually approaches to a target temperature. When the temperature of the fixing device becomes below the first temperature, the cooling device is controlled to stop. Accordingly, it is possible to maintain the temperature of the fixing device within the printable temperature range, thereby reducing a waiting time for the next printing operation.

BRIEF DESCRIPTION OF THE DRAWINGS

FIG. 15 is a table showing acceleration levels and deceleration levels of the cooling fan according to the third embodiment of the present invention;

DETAILED DESCRIPTION OF PREFERRED EMBODIMENTS

Figure 1:
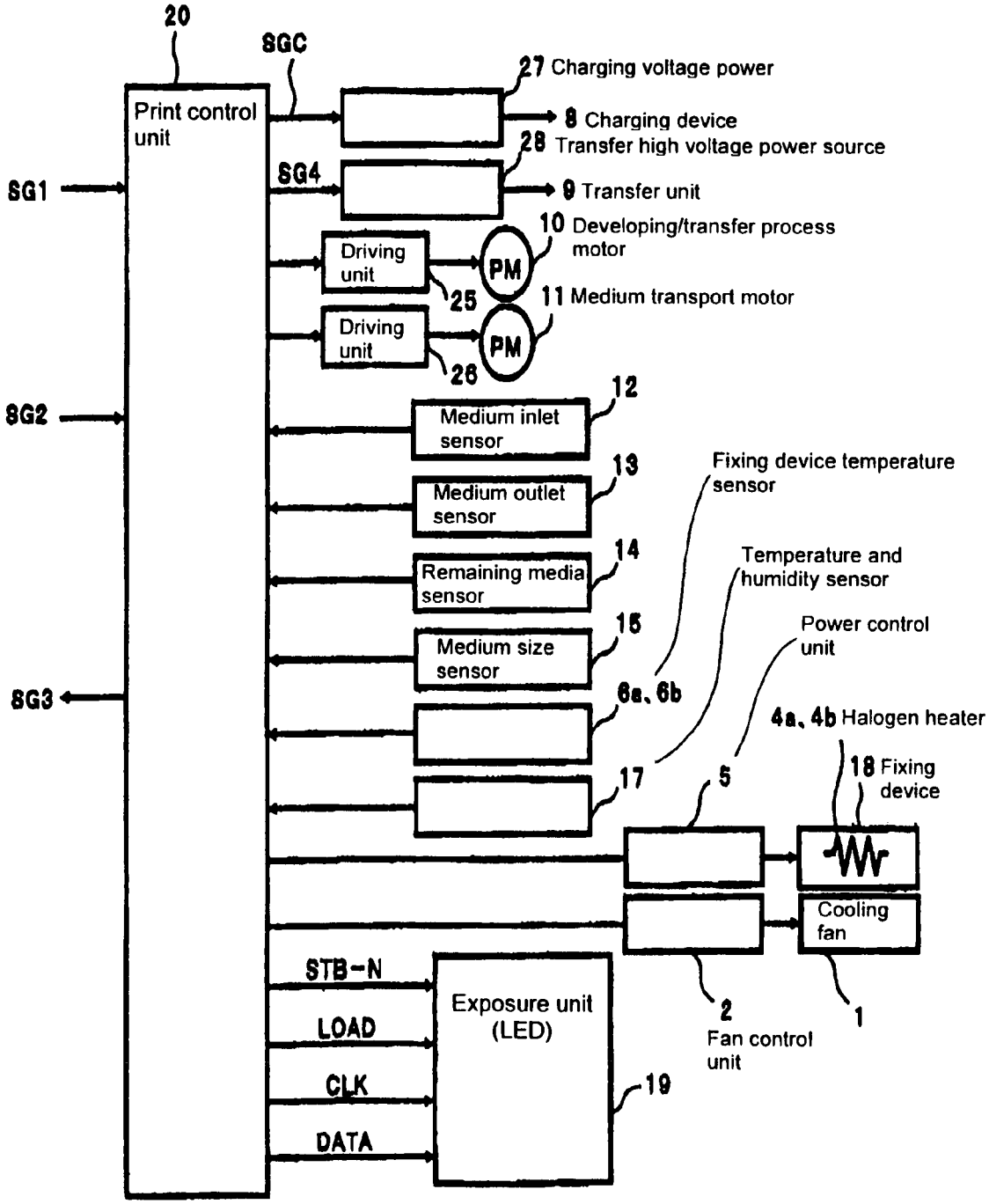
FIG. 1 is a schematic block diagram of a control system of an image forming apparatus according to a first embodiment of the present invention.

Hereunder, embodiments of the present invention will be explained with reference to the accompanying drawings. Components common in the drawings are designated by common reference numerals.

First Embodiment

In the first embodiment, an image forming apparatus is provided with a cooling fan as a cooling device. In the image forming apparatus, a specific temperature condition is set for stopping the cooling fan according to a time after the image forming apparatus completes printing. That is, after the image forming apparatus completes printing, when a temperature of a fixing device becomes below a specific temperature, the cooling fan stops, so that cooling effect of the cooling fan is reduced.

Figure 2:
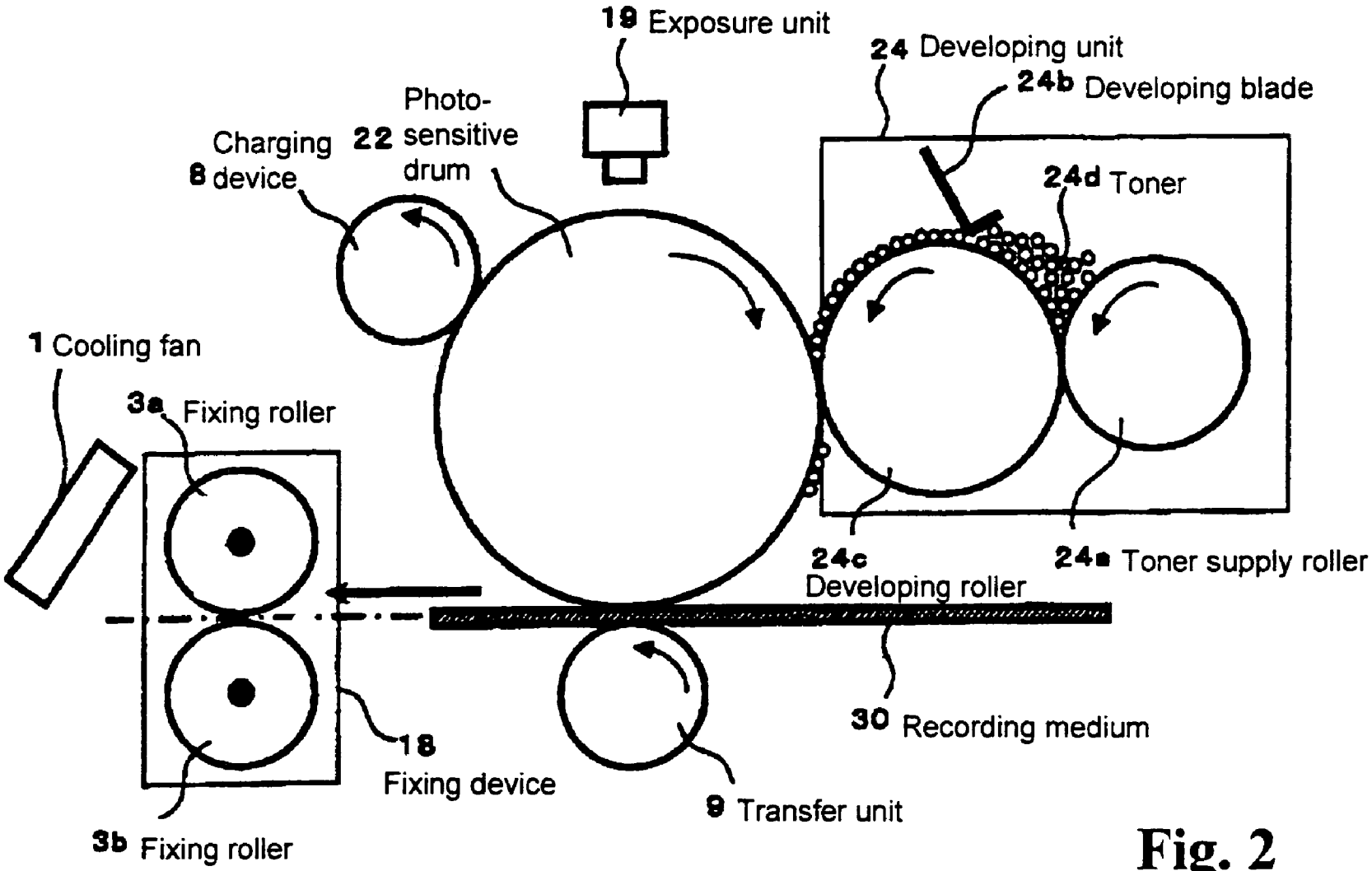
FIG. 2 is a schematic view showing a main configuration of the image forming apparatus.

FIG. 1 is a schematic block diagram of a control system of an image forming apparatus according to a first embodiment of the present invention. FIG. 2 is a schematic view showing a main configuration of the image forming apparatus. The image forming apparatus includes a print control unit 20 for controlling a printing operation; an exposure unit 19 for radiating exposure light according to control of the print control unit 20; a photo-sensitive drum 22 having a photo-sensitive member such as an organic thin layer for forming a latent image according to the exposure light from the exposure unit 19; a developing unit 24 for developing the latent image on the photo-sensitive drum 22; a transport unit (not shown) for transporting a recording medium 30; a transfer unit 9 for transferring a toner image developed on the photo-sensitive drum 22 to the recording medium 30; and a fixing unit or fixing device 18 for fixing the transferred image.

The developing unit 24 includes a toner supply roller 24*a* for supplying toner 24*d* supplied or replenished as necessary to a developing roller 24*c*; a developing blade 24*b* for forming a toner layer with a uniform thickness on the developing roller 24*c*; and the developing roller 24*c* for transferring the toner 24*d* to the photo-sensitive drum 22.

The print control unit 20 shown in FIG. 1 is formed of a microprocessor, a ROM, a RAM, an input/output port, and a timer, and is connected to an information processing device such as a personal computer (not shown). The print control unit 20 receives a control signal for controlling an operation of the image forming apparatus and image data such as bit map data through an image processing unit (not shown), so that the image forming apparatus executes a process such as printing.

The print control unit 20 receives a print data signal SG1 and a control signal SG2 (described later) from the image processing unit (not shown), and sends a response signal SG3 to the image processing unit. The print control unit 20 also sends a charge signal SGC so that a charging voltage power source 27 starts charging a charging device 8, and a transfer signal SG4 so that a transfer high voltage power source 28 starts charging the transfer unit 9.

The print control unit 20 is connected to driving units 25 and 26 for controlling rotational drive of a developing/transfer process motor 10 and a medium transport motor 11 through the driving units 25 and 26. The print control unit 20 is also connected to a power control unit 5 for controlling power to halogen heater 4*a* and 4*b* of the fixing device 18, and a fan control unit 2 for controlling on/off and a rotational speed of a cooling fan 1. Further, the print control unit 20 sends a STB-N signal, an LOAD signal, a CLK signal, and a DATA signal (described later) as a data signal and a control signal to the exposure unit 19.

The print control unit 20 receives signals from printing components such as a medium inlet sensor 12 for detecting the recording medium 30 upon printing; a medium outlet sensor 13 for detecting completion of printing; a remaining media sensor 14 for detecting a remaining amount of media from a thickness of the media; a medium size sensor 15 for detecting a size of a medium; fixing device temperature sensors 6*a* and 6*b* (described later); and a temperature and humidity sensor 17 for detecting a temperature and a humidity in a surrounding area of the fixing device 18 or inside the image forming apparatus.

Figure 3:
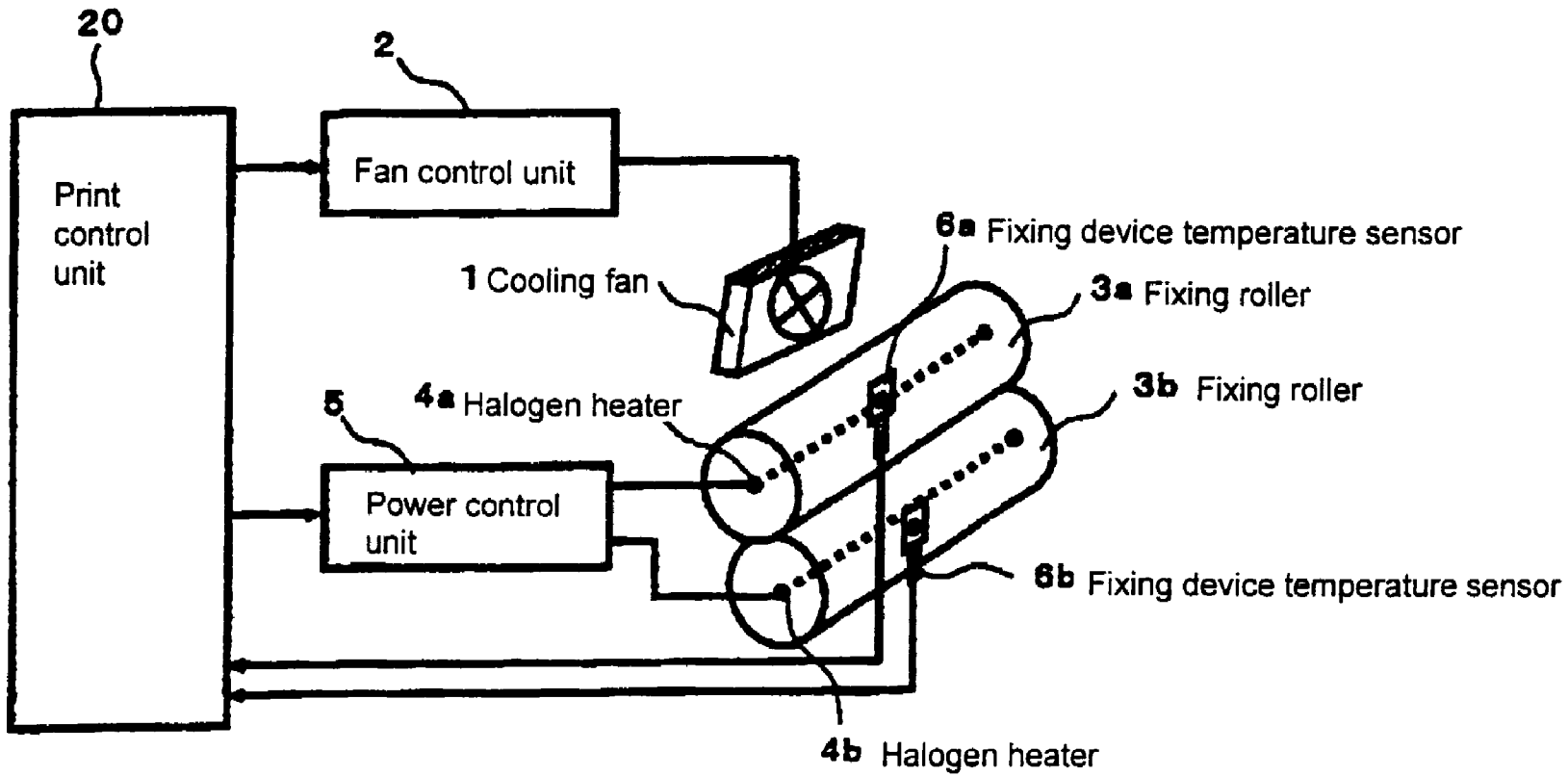
FIG. 3 is a schematic view showing a fixing device of the image forming apparatus.

FIG. 3 is a schematic view showing the fixing device 18 of the image forming apparatus. The fixing device 18 is provided with the cooling fan 1 for cooling fixing rollers 3*a* and 3*b*; the fan control unit 2 for controlling an operation of the cooling fan 1; the fixing roller 3*a* as an upper heating roller; the halogen heater 4*a* for heating the fixing roller 3*a*; the fixing roller 3*b* as a lower heating roller; the halogen heater 4*b* for heating the fixing roller 3*b*; the power control unit 5 for controlling power to the halogen heaters 4*a* and 4*b*; the temperature sensors 6*a* and 6*b* for detecting temperatures of the fixing rollers 3*a* and 3*b*, respectively; and a motor (not shown) for driving the fixing device 18.

The fixing roller 3*a* is connected to a motor (not shown), and rotates forward or in reverse according to a command from the print control unit 20. The fixing roller 3*b* is pressed against the fixing roller 3*a*, so that the fixing roller 3*b* rotates forward or in reverse accompanied with the fixing roller 3*a*. The temperature sensors 6*a* and 6*b* such as thermistor are attached to the fixing rollers 3*a* and 3*b* for detecting surface temperatures thereof separately, and send outputs to the print control unit 20. The temperature sensors 6*a* and 6*b* are not limited to thermistor, and may be a temperature sensor for detecting a wave length of radiated infrared light without contact to detect a temperature.

The power control unit 5 is connected to the halogen heaters 4*a* and 4*b*, so that the print control unit 20 individually controls the halogen heaters 4*a* and 4*b* according to temperatures detected by the temperature sensors 6*a* and 6*b*.

As described above, in the embodiment, it is possible to individually control temperatures of the halogen heaters 4*a* and 4*b*, and the surface temperatures of the fixing rollers 3*a* and 3*b* are referred to as a temperature of the fixing device 18. The temperature of the fixing device 18 may be a same surface temperature of the fixing rollers 3*a* and 3*b*, or an average temperature of the surface temperatures of the fixing rollers 3*a* and 3*b*.

In the above description, the halogen heater is provided as a heating source, and the heating source is not limited to the halogen heater. The cooling fan 1 is disposed on a side of the fixing roller 3*a* at an upper portion, and may be disposed on a side of the fixing roller 3*b* at a lower portion, or a middle of the fixing rollers 3*a* and 3*b* as far as the cooling fan 1 does not interfere the transportation of the recording medium 30.

Figure 4:
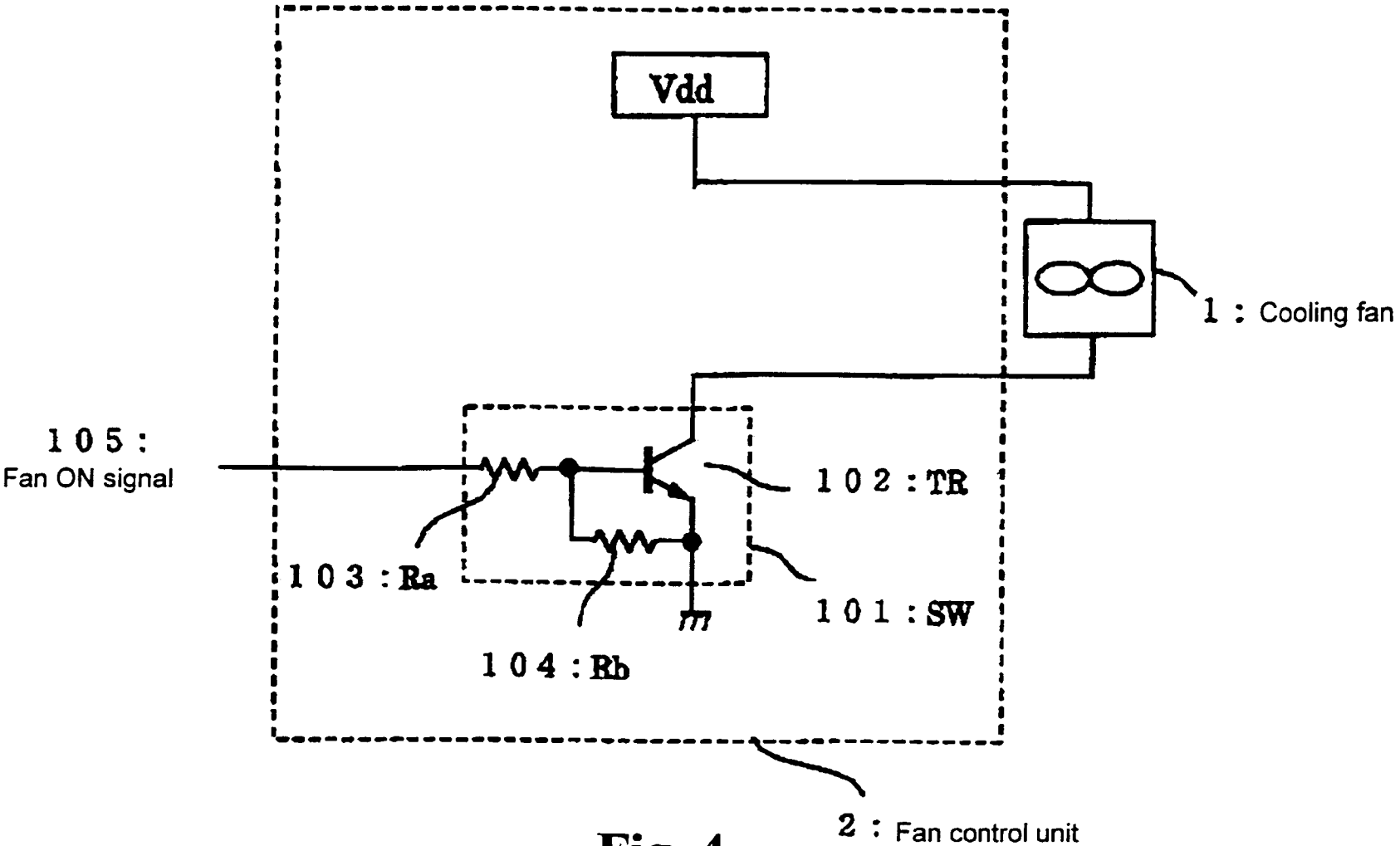
FIG. 4 is a schematic view showing a cooling fan control unit according to the first embodiment of the present invention.

FIG. 4 is a schematic view showing the cooling fan control unit 2 according to the first embodiment of the present invention. The cooling fan control unit 2 is connected to the cooling fan 1 and the print control unit 20 (not shown in FIG. 4). One end of the cooling fan 1 is connected to a power source Vdd, and the other end of the cooling fan 1 is connected to a collector terminal of a transistor TR 102 in a switch SW 101. An emitter terminal of the transistor TR 102 in the switch SW 101 is connected to ground and an end of a resistance Rb 104. The other end of the resistance Rb 104 is connected to a base terminal of the transistor TR 102 and an end of a resistance Ra 103. The other end of the resistance Ra 103 is connected to the print control unit 20 (not shown in FIG. 4) for sending a fan ON signal 105.

A printing operation of the image forming apparatus according to the first embodiment will be explained next. First, the image processing unit (not shown) forms print data with bit-map format as one-dimensionally arranged data, and a control signal is sent to the image forming apparatus for instructing the printing operation. The print data is sent to the print control unit 20 as a video signal.

When the print control unit 20 receives the control signal of the print instruction from the image processing unit, the print control unit 20 determines whether the fixing device temperature sensors 6*a* and 6*b* detect the temperatures of the fixing device 18 having the fixing rollers 3*a* and 3*b* with the halogen heaters 4*a* and 4*b* within a printable temperature range. When the temperatures are not within the printable temperature range, the print control unit 20 supplies power to the halogen heaters 4*a* and 4*b* to heat the fixing device 18.

Then, the print control unit 20 controls the driving unit 25 to rotate the developing/transfer process motor 10, and sends the charge signal SGC to operate the charging voltage power source 27 to charge the charging device 8, thereby charging the surface of the photo-sensitive drum 22. The print control unit 20 detects the existence and the type of the recording medium 30 placed on the image forming apparatus with the remaining media sensor 14 and the medium size sensor 15. When the print control unit 20 detects the recording medium 30, the print control unit 20 controls the driving unit 26 to start transporting the recording medium 30. The medium transport motor 11 is capable of rotating in both directions. When the print control unit 20 controls the driving unit 26 to start transporting the recording medium 30, the medium transport motor 11 rotates in reverse to transport the recording medium 30 for a specific distance until the medium inlet sensor 12 detects the recording medium 30.

Afterwards, the medium transport motor 11 rotates forward to transport the recording medium 30 into a printing unit in the image forming apparatus. When the recording medium 30 reaches a printable position, the print control unit 20 sends a timing signal including a main-scanning synchronous signal and a sub-scanning synchronous signal to the image processing unit. Upon receiving the timing signal, the image processing unit synchronizes the print data arranged one-dimensionally as the video signal with the timing signal, and sends the same to the print control unit 20 per a printing line.

Then, the print control unit 20 synchronizes the video signal as the print data signal DATA with a clock signal CLK generated separately, and sends the same to the exposure unit 19 sequentially. When the print data signal DATA corresponding to one printing line is sent, the print control unit 20 switches a load signal LOAD supplied to the exposure unit 19 to an effective level (high level) for a specific period of time, so that the print data corresponding to the print data signal DATA is maintained in the exposure unit 19.

After the print data is maintained in the exposure unit 19, the print control unit 20 switches a strobe signal STB-N to an effective level (low level) for a specific period of time. The strobe signal STB-N is used for controlling the drive of the exposure unit 19 according to the print data maintained in the exposure unit 19. When the strobe signal STB-N is at the low level, the exposure unit 19 drives each LED element to generate recording light according to the print data.

The LED elements radiate the recording light on the photo-sensitive drum 22 charged with negative potential by the charging device 8, so that a radiated spot corresponding to each LED forms the latent image as a dot with elevated potential. In the developing unit 24, the toner 24*d* with negative potential is attracted to each dot through strong electrical attraction to form the toner image. When the photo-sensitive drum 22 rotates until the toner image moves to a position facing the transfer unit 9, the transfer high voltage power source 28 starts an operation upon receiving the transfer signal SG4 to charge the transfer unit 9 with positive voltage, so that the toner image is transferred to the recording medium 30 passing between the transfer unit 9 and the photo-sensitive drum 22.

When the recording medium 30 with the toner image contacts with the fixing rollers 3*a* and 3*b* of the fixing device 18, the toner image is fixed on the recording medium 30 with heat of the fixing device 18. After the toner image is fixed, the recording medium 30 is transported and discharged outside from the printing unit of the image forming apparatus through the medium outlet sensor 13. According to the detection signals of the medium size sensor 15 and the medium inlet sensor 12, the print control unit 20 applies the voltage from the transfer high voltage power source 28 to the transfer unit 9 only during the recording medium 30 is passing through the transfer unit 9. When the recording medium 30 passes through the medium outlet sensor 13, the charging voltage power source 27 stops supplying voltage to the charging device 8, and the developing/transfer process motor 10 stops.

Figure 5:
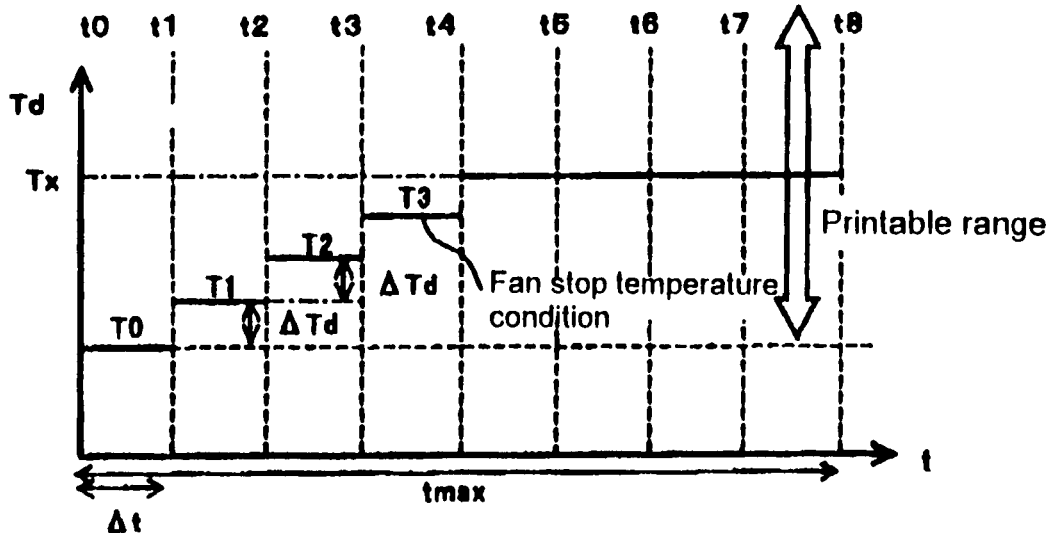
FIG. 5 is a time chart showing a fan stop condition No. 1 of the image forming apparatus according to the first embodiment of the present invention.
Figure 6:
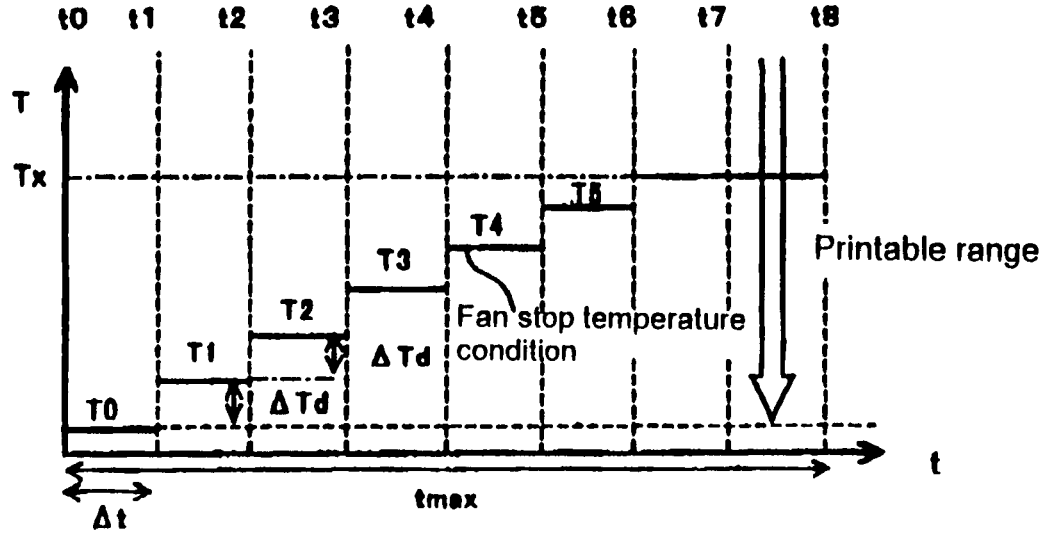
FIG. 6 is a time chart showing a fan stop condition No. 2 of the image forming apparatus according to the first embodiment of the present invention.

An operation of the fixing device of the image forming apparatus according to the first embodiment will be explained next. FIG. 5 is a time chart showing a fan stop condition No. 1 of the image forming apparatus according to the first embodiment of the present invention. FIG. 6 is a time chart showing a fan stop condition No. 2 of the image forming apparatus according to the first embodiment of the present invention. As shown in FIGS. 5 and 6, in the image forming apparatus according to the first embodiment, a fan stop temperature is set such that the fan stop temperature increases by a specific temperature increment ΔTd at every predetermined time Δt from a lower limit T0 of the printable temperature range, so that the fan stop temperature gradually becomes close to a target temperature Tx.

As shown in FIG. 5, the fan stop temperature becomes the target temperature TX after increasing four times from the lower limit T0. As shown in FIG. 6, when the lower limit T0 is set at a lower temperature, the fan stop temperature becomes the target temperature TX after increasing six times. In FIGS. 5 and 6, a maximum fan operating time tmax is set at t8 at which the fan stop temperature increases eight times (Δt×8). The maximum fan operating time tmax is not limited to t8, and may be smaller or larger. The lower limit T0 is set according to a delay in heating or cooling due to heat capacity and accuracy of the sensors.

Figure 7:
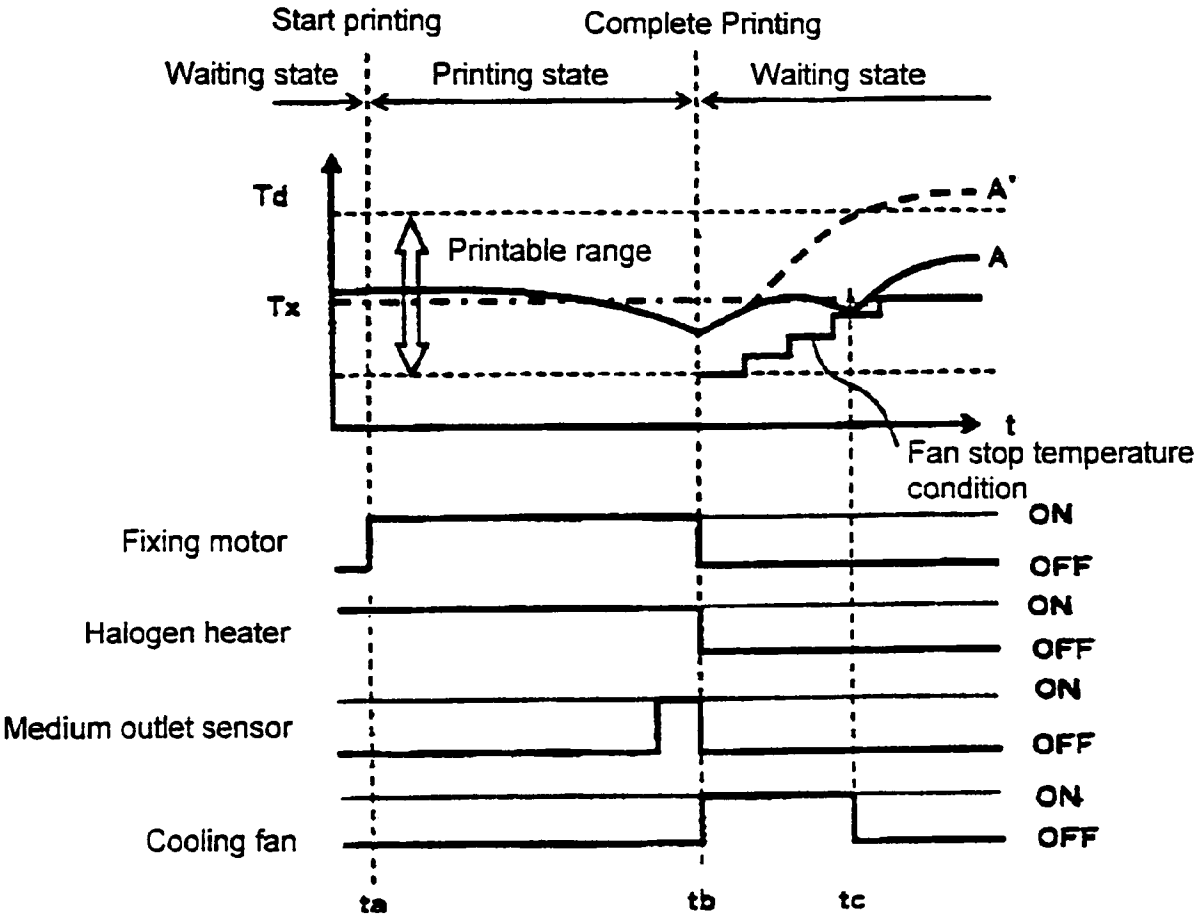
FIG. 7 is a time chart showing a process of controlling a temperature of the fixing device according to the first embodiment of the present invention.

A process of controlling the temperature of the fixing device according to the fan stop temperature condition will be explained next. FIG. 7 is a time chart showing the process of controlling the temperature of the fixing device 18 according to the fan stop temperature condition described above. After the halogen heaters 4*a* and 4*b* are turned on, when the temperature sensors 6*a* and 6*b* detect the temperature Td of the fixing device 18 within the printable temperature range, the fixing motor is turned on to start printing (timing ta). When the medium outlet sensor 13 detects completion of the printing, the cooling fan 1 starts (timing tb).

During the printing and fixing process, the halogen heaters 4*a* and 4*b* keep on. However, the recording medium 30 absorbs heat, so that the temperature Td of the fixing device 18 gradually decreases as shown in FIG. 7. When the number of sheets is not large, or the sheet has a small thickness, an amount of absorbed heat is small, so that the temperature Td does not decrease to a large extent. When the printing is completed, the halogen heaters 4*a* and 4*b* are turned off. At this moment, the temperature Td of the fixing device 18 keeps increasing due to stored heat according to the heat capacity. Accordingly, the cooling fan 1 starts (timing tb). Then, when the temperature Td of the fixing device 18 becomes below the fan stop temperature set per the specific time increment as described above, the cooling fan 1 stops (timing tc).

With a conventional controlling method, the temperature of the fixing device may exceed the printable temperature range, thereby causing over-shoot indicated by a hidden line A'. On the other hand, with the control process described above, the temperature Td of the fixing device 18 changes along a solid line A within the printable temperature range, thereby reducing a waiting time for the next printing operation. In a case that the fixing device is cooled after the maximum fan operating time tmax, when the temperature Td of the fixing device 18 is still above the fan stop temperature, it is preferred to stop the cooling fan 1, thereby preventing over-cooling the fixing device 18.

Figure 8:
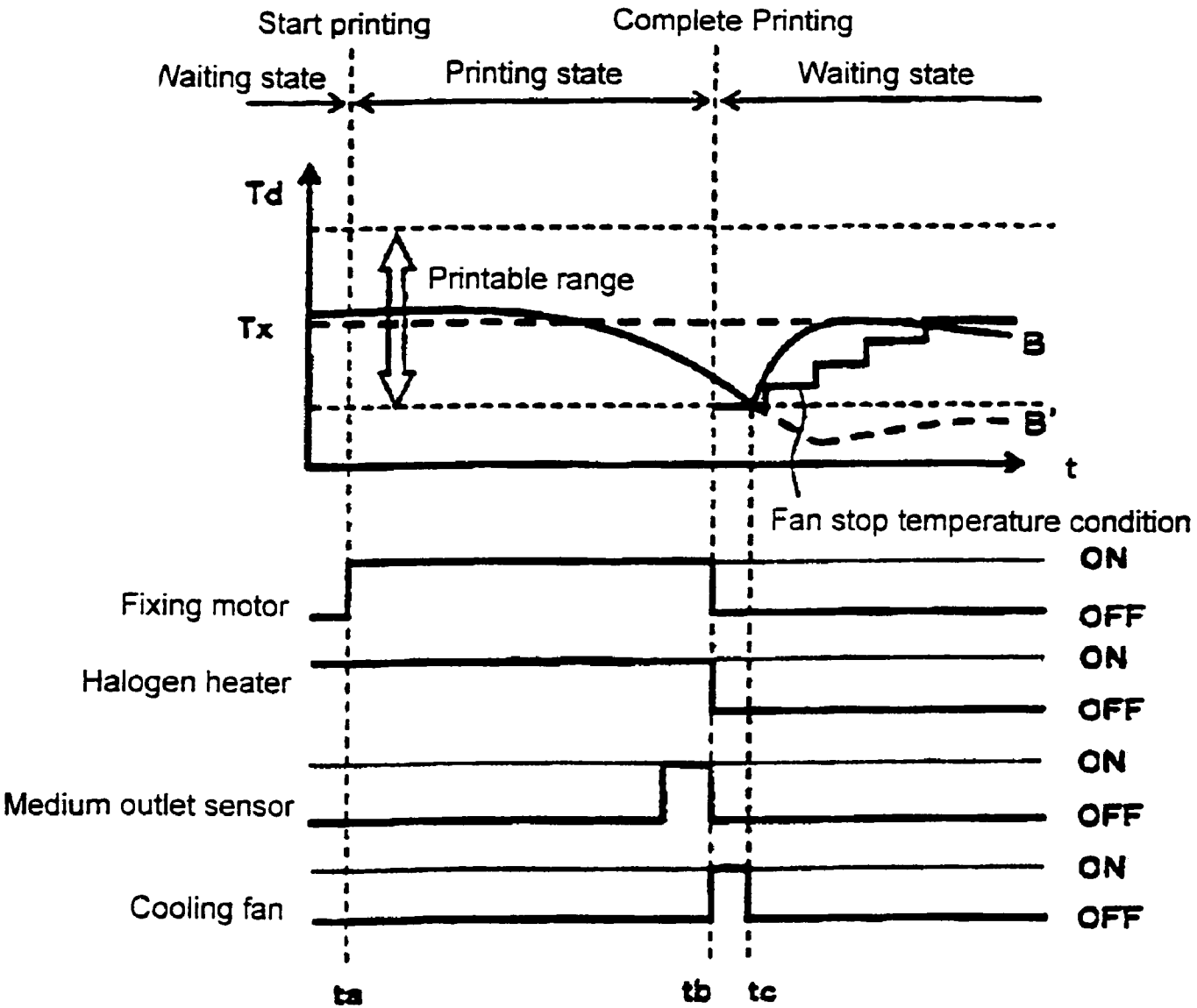
FIG. 8 is a time chart showing a process of controlling a temperature of the fixing device according to the first embodiment of the present invention.

FIG. 8 is a time chart showing another process of controlling the temperature of the fixing device 18. After the halogen heaters 4*a* and 4*b* are turned on, when the temperature sensors 6*a* and 6*b* detect the temperature Td of the fixing device 18 within the printable temperature range, the fixing motor is turned on to start printing (timing Ta). When the medium outlet sensor 13 detects completion of the printing, the cooling fan 1 starts (timing tb).

During the printing and fixing process, the halogen heaters 4*a* and 4*b* keep on. However, the recording medium 30 absorbs heat, so that the temperature Td of the fixing device 18 gradually decreases as shown in FIG. 8. When the number of sheets is large, or the sheet has a large thickness, an amount of absorbed heat becomes large, so that the temperature Td decreases to a large extent. When the printing is completed, the halogen heaters 4*a* and 4*b* are turned off. At this moment, the temperature Td of the fixing device 18 keeps increasing due to stored heat according to the heat capacity. Accordingly, the cooling fan 1 starts (timing tb). When the temperature Td of the fixing device 18 becomes below the fan stop temperature set per the specific time increment as described above, the cooling fan 1 stops (timing tc).

As described above, when a large number of sheets are printed, an amount of absorbed heat becomes large, so that the temperature Td decreases to a large extent. With a conventional controlling method, the temperature of the fixing device may become below the printable temperature range, thereby causing under-shoot indicated by a hidden line B'. On the other hand, with the control process described above, the temperature Td of the fixing device 18 changes along a solid line B within the printable temperature range, thereby reducing a waiting time for the next printing operation.

Figure 9:
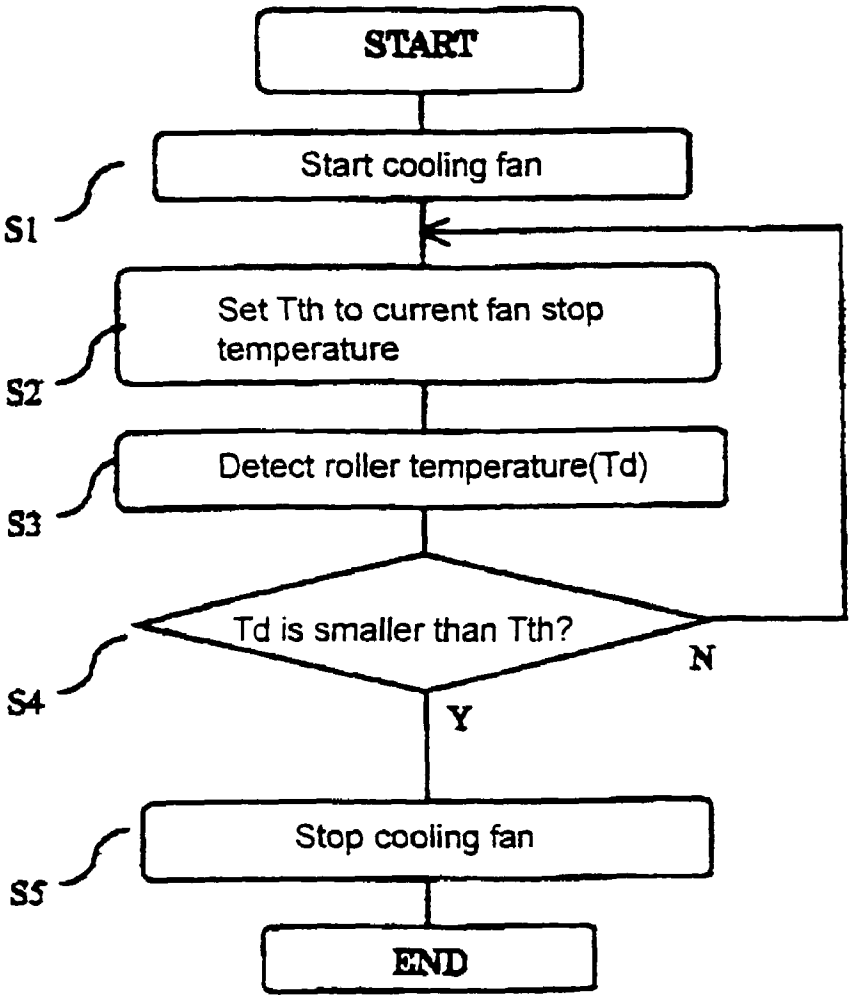
FIG. 9 is a flow chart showing a process of controlling a cooling fan according to the first embodiment of the present invention.

A process of controlling an operation of the cooling fan 1 according to the temperature of the fixing roller 3*a* will be explained next. FIG. 9 is a time chart showing the process of controlling the operation of the cooling fan 1.

In step S1, after the printing, the print control unit 20 switches the fan ON signal 105 to a high level to start the cooling fan 1. In step S2, a threshold temperature Tth is set at a value corresponding to the fan stop temperature at the specific time after the cooling fan starts according to the fan stop conditions shown in FIGS. 5 and 6 for controlling the cooling fan. In this step, the print control unit 20 measures the specific time after the cooling fan starts.

In step S3, the print control unit 20 detects a temperature measured by the temperature sensor 6*a* to determine the temperature Td of the fixing device 18. In step S4, the print control unit 20 compares the temperature Td with the threshold temperature Tth. When the temperature Td is smaller than the threshold temperature Tth, the process proceeds to step S5. When the temperature Td is greater than the threshold temperature Tth, the process proceeds to step S2. In step S5, when the temperature Td becomes below the threshold temperature Tth (the fixing device 18 is sufficiently cooled), the print control unit 20 stops the cooling fan 1.

As described above, in the image forming apparatus of the first embodiment, the fan stop temperature is set according to the specific time after the printing is completed. When the temperature of the fixing device becomes below the fan stop temperature, the cooling fan stops. Accordingly, it is possible to securely maintain the temperature of the fixing device within the printable temperature range, thereby reducing the waiting time for the next printing operation.

Second Embodiment

In an image forming apparatus according to the second embodiment of the present invention, in addition to the fan stop temperature, a fan resume temperature is set to resume an operation of the cooling fan according to a specific time after the printing is completed. Configurations of the image forming apparatus, the system control thereof, and the fixing device in the second embodiment are the same as those of the image forming apparatus in the first embodiment shown in FIGS. 1 to 3, and explanations thereof are omitted. Also, a printing operation of the image forming apparatus in the second embodiment is the same as that of the image forming apparatus in the first embodiment, and an explanation thereof is omitted.

Figure 10:
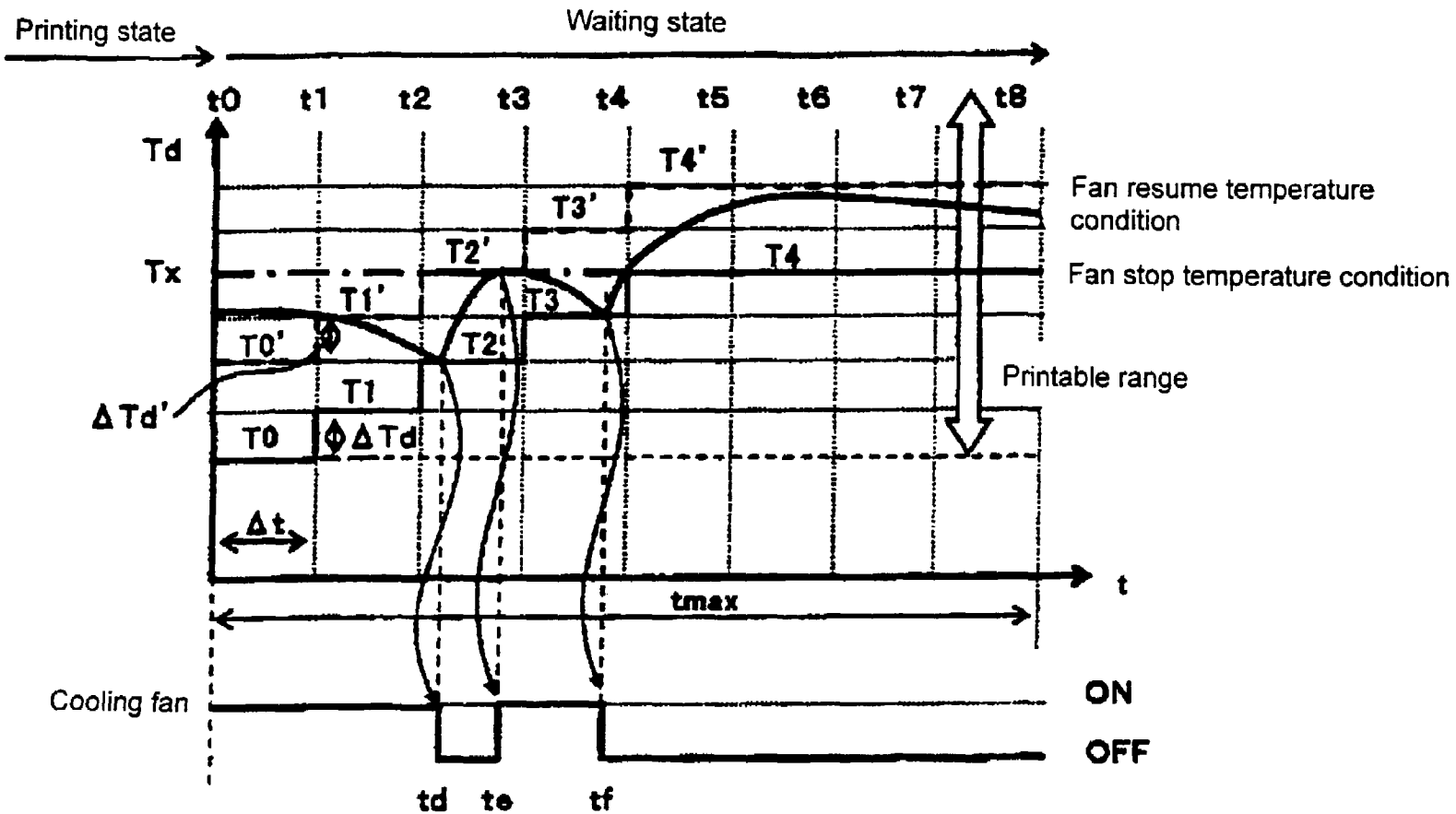
FIG. 10 is a time chart showing an operation of a cooling fan according to a second embodiment of the present invention.

FIG. 10 is a time chart showing the operation of the cooling fan according to the second embodiment of the present invention. The horizontal axis represents time t after the printing is completed, and the vertical axis represents the temperature Td of the fixing device 18. A solid line and hidden line in FIG. 10 represent the temperature conditions for stopping or resuming the cooling fan (described later). As shown in FIG. 10, in the image forming apparatus according to the second embodiment, the fan stop temperature is set such that the fan stop temperature increases by the specific temperature increment ΔTd at every predetermined time Δt from the lower limit T0 of the printable temperature range, so that the fan stop temperature gradually becomes close to the target temperature Tx.

In the second embodiment, the fan resume temperature is set such that the fan resume temperature increases by a specific temperature increment ΔTd' at every predetermined time Δt from a specific starting point. In the embodiment, the specific starting point is a temperature increased from the lower limit T0 of the printable temperature range by double of ΔTd (2×ΔTd). Alternatively, the fan resume temperature may be set to be a temperature increased by a specific temperature from the fan stop temperature. Further, the fan resume temperature may be set such that the fan resume temperature increases by a specific temperature increment having a value gradually decreasing, so that the fan resume temperature gradually becomes close to the target temperature Tx.

As shown in FIG. 10, the fan stop temperature becomes the target temperature TX after increasing four times from the lower limit T0 of the printable temperature range. As shown in FIG. 6, when the lower limit T0 can be set at a lower temperature, the fan stop temperature becomes the target temperature TX after increasing six times. In this case, the fan resume temperature increases six times as well.

As shown in FIG. 10, the maximum fan operating time tmax is set at t8 at which the fan stop temperature increases eight times. Similar to the first embodiment, the maximum fan operating time tmax is not limited to t8, and may be smaller or larger. The lower limit T0 is set at a temperature shifted from an actual limit by a specific margin according to a delay in heating or cooling due to heat capacity and accuracy of the sensors.

A process of controlling a temperature of the fixing device 18 according to the fan stop temperature will be explained next. In the process, the cooling fan 1 stops when the temperature Td of the fixing device 18 becomes below the fan stop temperature, and the cooling fan 1 starts when the temperature Td of the fixing device 18 becomes above the fan resume temperature.

When the printing is completed, the print control unit 20 starts the cooling fan 1 to prevent the over shoot (timing t0) The cooling fan 1 keeps operating until the temperature sensors 6*a* and 6*b* detect the temperature Td of the fixing device 18 below the fan stop temperature. When the temperature Td becomes below the fan stop temperature, i.e., a temperature T2 in the embodiment, the cooling fan 1 stops (timing td). When the temperature Td of the fixing device 18 increases again and becomes above the fan resume temperature, i.e., a temperature T2' in the embodiment, the cooling fan 1 starts again (timing te). When the cooling fan 1 cools the fixing device 18 and the temperature Td becomes below the fan stop temperature, i.e., a temperature T3 in the embodiment, the cooling fan 1 stops (timing tf).

The steps described above are repeated from the print completion (timing t0) to the maximum fan operating time tmax. Accordingly, as shown in FIG. 10, it is possible to maintain the temperature Td of the fixing device 18 within the printable temperature range.

Figure 11:
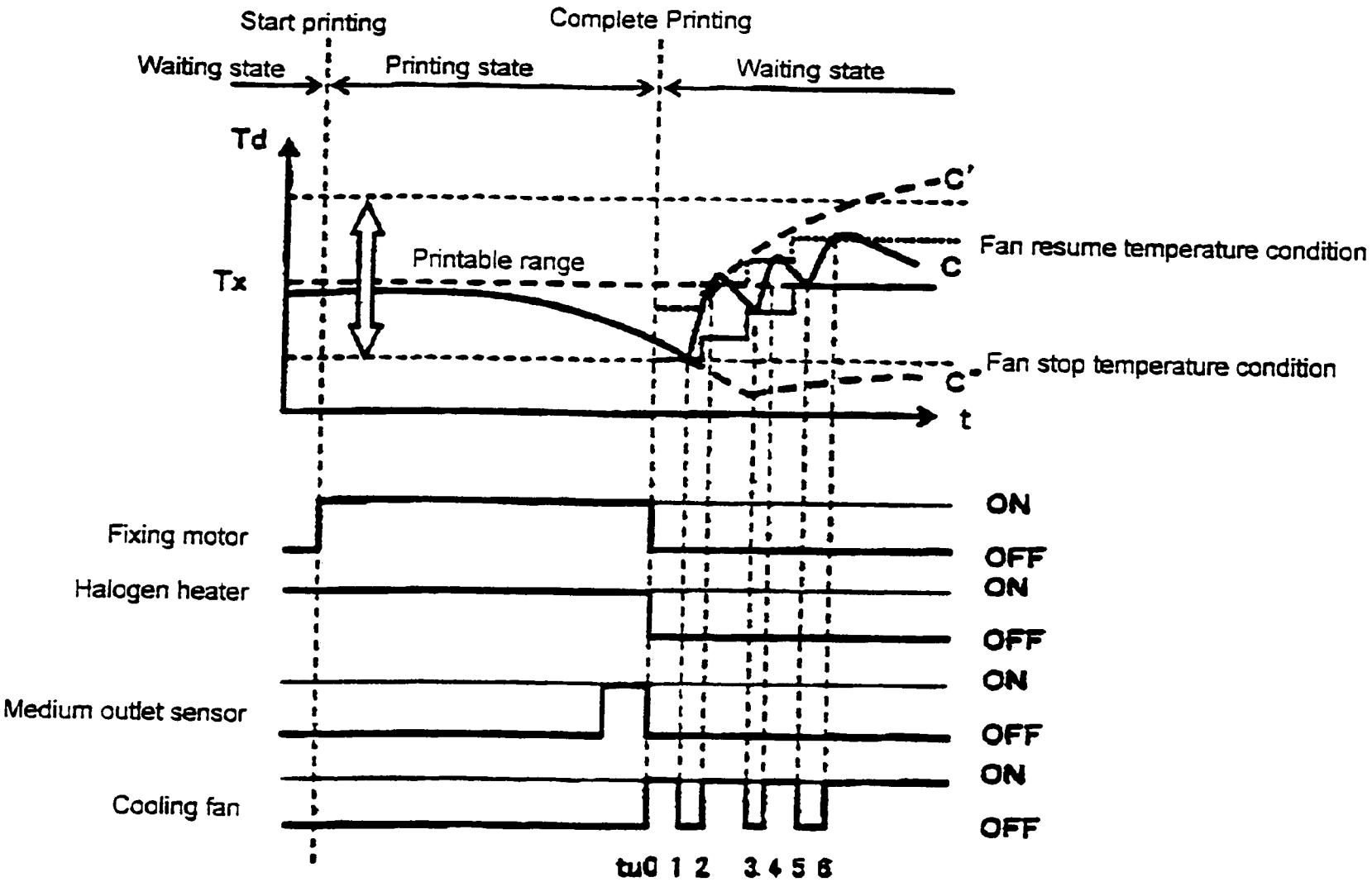
FIG. 11 is a time chart showing a process of controlling a temperature of a fixing device according to the second embodiment of the present invention.

FIG. 11 is a time chart showing another process of controlling the temperature Td of the fixing device 18 according to the second embodiment of the present invention. In this case, the fixing device 18 has a different heat capacity or a different number of sheets absorb heat.

As shown in FIG. 11, when the printing is completed, the print control unit 20 starts the cooling fan 1 (timing tu0). When the temperature Td of the fixing device 18 becomes alternately below the fan stop temperature and above the fan resume temperature at timings tu1 to tu6, the cooling fan 1 switches on and off, so that the temperature Td of the fixing device 18 is controlled along a solid line C.

With a conventional controlling method, when the fixing device 18 has a large heat capacity or a small number of sheets absorb a small amount of heat, the temperature of the fixing device may exceed the printable temperature range, thereby causing over-shoot indicated by a hidden line C'. Similarly, when the fixing device 18 has a small heat capacity or a large number of sheets absorb a large amount of heat, the temperature of the fixing device may decrease below the printable temperature range, thereby causing under-shoot indicated by a hidden line C". On the other hand, with the control process described above, the temperature Td of the fixing device 18 is maintained within the printable temperature range.

Figure 12:
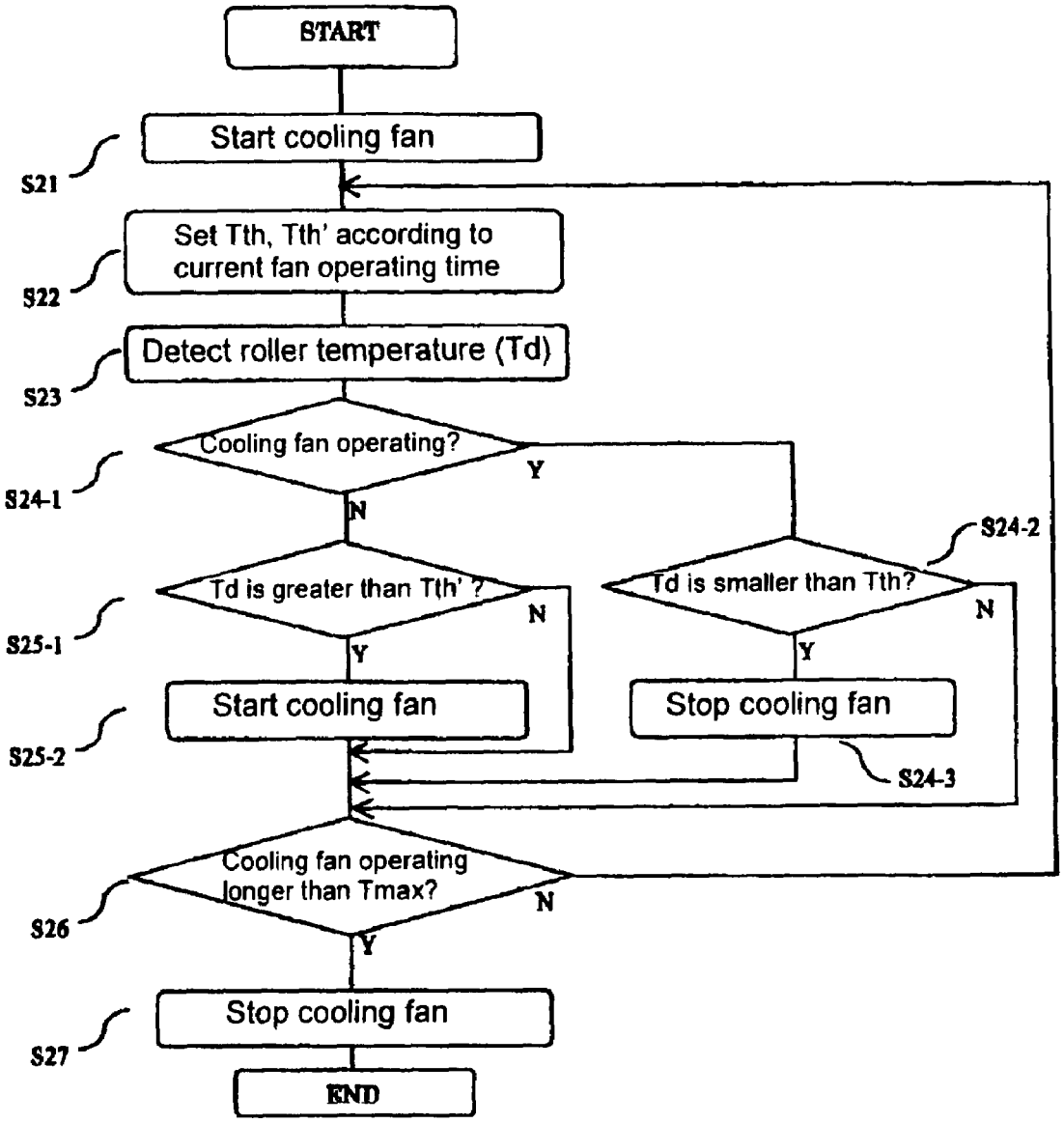
FIG. 12 is a flow chart showing a process of controlling the cooling fan according to the second embodiment of the present invention.

A process of controlling an operation of the cooling fan 1 will be explained next. A configuration of a cooling fan control unit is the same as that of the cooling fan control unit 2 in the first embodiment, and explanation thereof is omitted. FIG. 12 is a flow chart showing the process of controlling the cooling fan according to the second embodiment of the present invention.

In step S21, after the printing is completed, the print control unit 20 switches the fan ON signal 105 to a high level to start the cooling fan 1. In step S22, threshold temperatures Tth and Tth' are set at values corresponding to the fan stop temperature and the fan resume temperature, respectively, at the specific time after the cooling fan starts according to the fan stop and resume conditions shown in FIG. 10. In this step, the specific time is set similarly to the first embodiment.

In step S23, the print control unit 20 detects the temperature Td of the fixing device 18. In step S24-1, it is determined whether the cooling fan 1 is operating. When the cooling fan 1 is operating, the process proceeds to step S24-2, and when the cooling fan 1 is not operating, the process proceeds to step S25-1. In step S24-2, the print control unit 20 compares the temperature Td with the threshold temperature Tth. When the temperature Td is smaller than the threshold temperature Tth, the print control unit 20 stops the cooling fan 1 (S24-3). When the temperature Td is greater than the threshold temperature Tth, the process proceeds to step S26.

In step S25-1, when the temperature Td is above the threshold temperature Tth', the print control unit 20 starts the cooling fan 1 (S25-2). When the temperature Td is smaller than the threshold temperature Tth', the process proceeds to step S26. In step S26, it is determined that the maximum fan operating time tmax is passed. When the maximum fan operating time tmax is passed, the print control unit 20 stops the cooling fan 1 (S27). When the maximum fan operating time tmax is not passed, the process returns to step S22.

As described above, in the image forming apparatus of the second embodiment, the fan stop temperature and the fan resume temperature are set according to the specific time after the printing is completed. When the temperature of the fixing device becomes below the fan stop temperature, the cooling fan stops. When the temperature of the fixing device becomes above the fan resume temperature, the cooling fan starts. Accordingly, even when the fixing device has a different heat capacity, or a different number of sheets are processed, it is possible to securely maintain the temperature of the fixing device within the printable temperature range, thereby reducing the waiting time for the next printing operation.

Third Embodiment

In an image forming apparatus according to the third embodiment of the present invention, a fan acceleration temperature or a fan deceleration temperature is set to accelerate or decelerate a speed of the cooling fan according to a specific time after the printing is completed. Configurations of the image forming apparatus, the system control thereof, and the fixing device in the third embodiment are the same as those of the image forming apparatus in the first embodiment shown in FIGS. 1 to 3, and explanations thereof are omitted.

Figure 13:
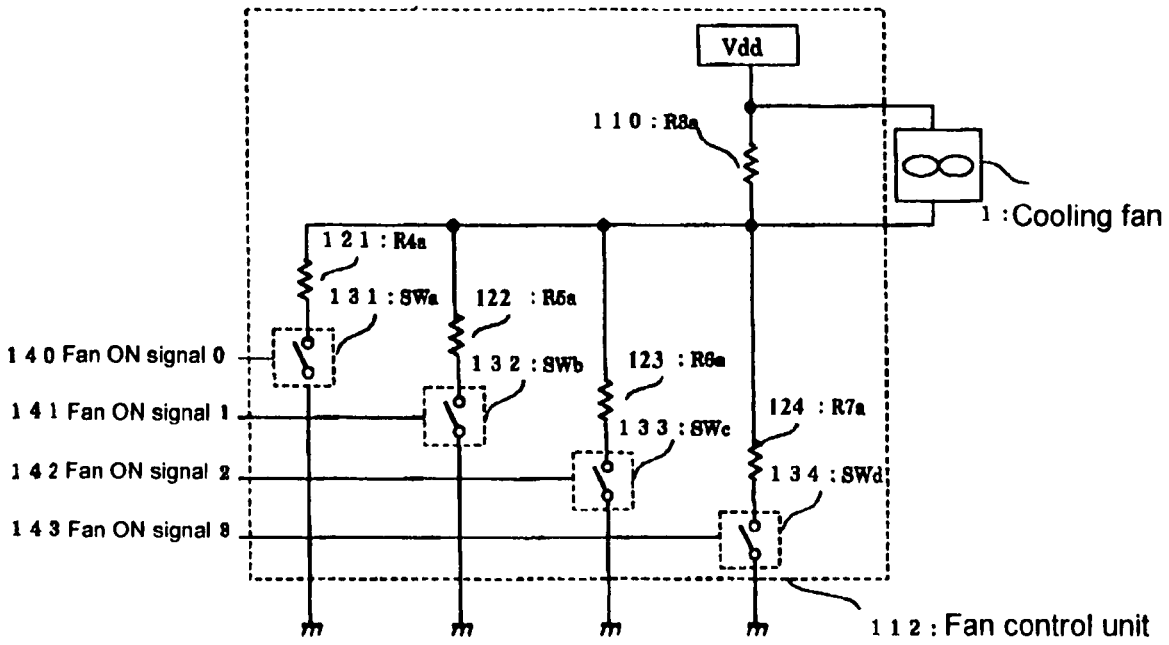
FIG. 13 is a schematic view showing a cooling fan control unit according to a third embodiment of the present invention.

FIG. 13 is a schematic view showing a cooling fan control unit 112 according to the third embodiment of the present invention. Only components different from those in the first embodiment will be explained.

An end of the cooling fan 1 is connected to a power source Vdd and an end of a resistance R3*a* 110. The other end of the cooling fan 1 is connected to the other end of the resistance R3*a* 110 and ends of resistances R4*a* 121, R5*a* 122, R6*a* 123, and R7*a* 124. The other ends of the resistances R4*a* 121, R5*a* 122, R6*a* 123, and R7*a* 124 are connected to ends of switches SWa 131, SWb 132, SWc 133, and SWd 134, respectively. The other ends of the switches SWa 131, SWb 132, SWc 133, and SWd 134 are connected to ground. Control terminals of the switches SWa 131, SWb 132, SWc 133, and SWd 134 receive fan ON signals 0 140, 1 141, 2 142, and 3 143 from the print control unit 20 (not shown in FIG. 13). The switches SWa 131, SWb 132, SWc 133, and SWd 134 have a configuration same as that of the switch in the first or second embodiment.

The resistances R4*a* 121, R5*a* 122, R6*a* 123, and R7*a* 124 have different values of resistance, respectively. For example, the resistance R4*a* 121 has a value of resistance smaller than that of the resistance R5*a* 122; the resistance R5*a* 122 has a value of resistance smaller than that of R6*a* 123; and the resistance R6*a* 123 has a value of resistance smaller than that of the resistance R7*a* 124.

When only the switch SWa 131 is operated and the other switches are not operated, a voltage Va is applied to the both ends of the cooling fan 1. Similarly, in the cases that only one of the switches SWb 132, SWc 133, and SWd 134 is operated, a voltage Vb, Vc, or Vd is applied to the both ends of the cooling fan 1. In this case, the voltage Va has a value greater than that of the voltage Vb; the voltage Vb has a value greater than that of the voltage Vc; and the voltage Vc has a value greater than that of the voltage Vd.

Accordingly, when only the switch SWd 134 is operated and the other switches are not operated, the cooling fan 1 rotates at the lowest speed. When only the switch SWa 131 is operated and the other switches are not operated, the cooling fan 1 rotates at the highest speed.

A printing operation of the image forming apparatus in the third embodiment is the same as that of the image forming apparatus in the first embodiment or the second embodiment, and an explanation thereof is omitted.

Figure 14:
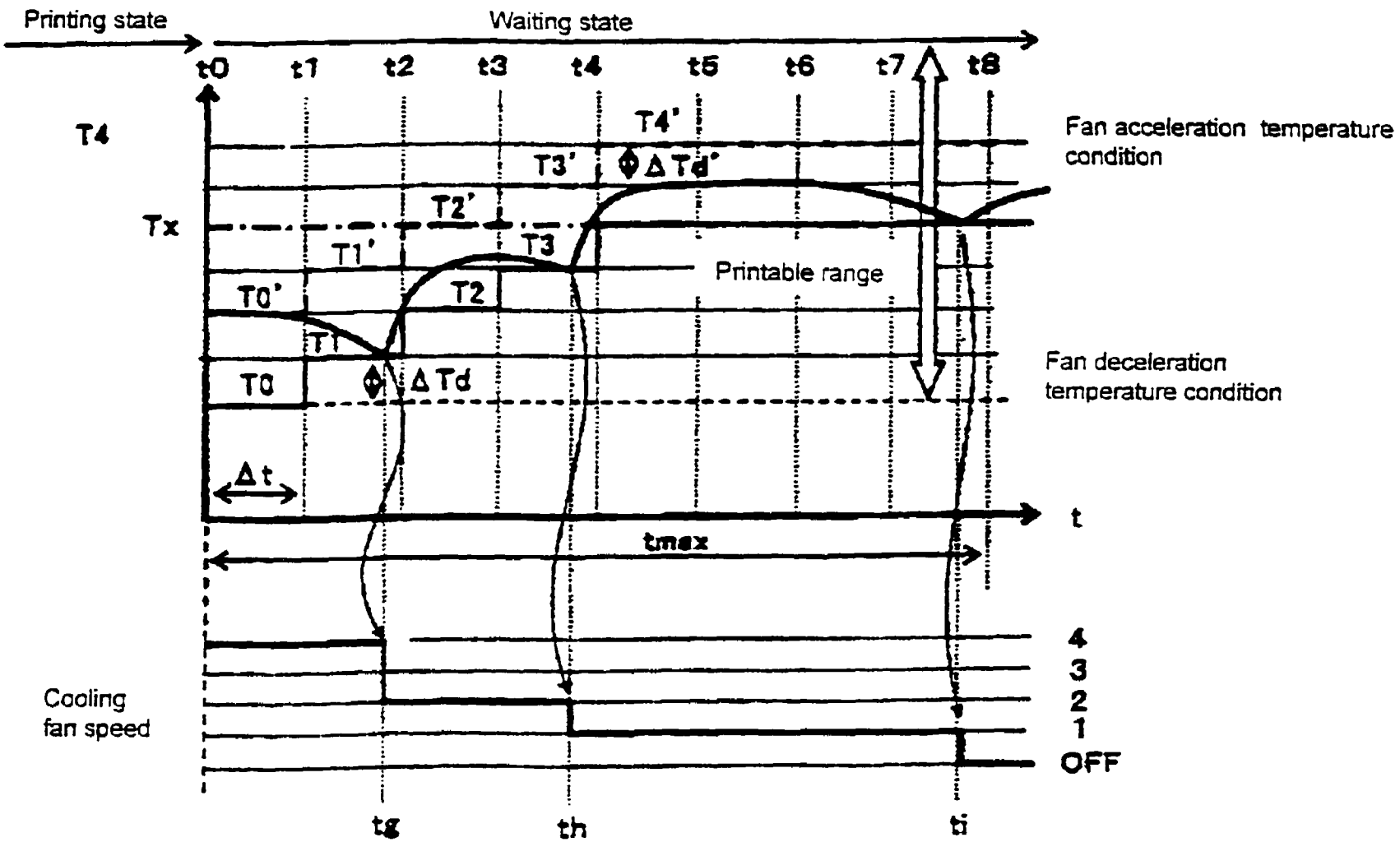
FIG. 14 is a time chart showing an operation of the cooling fan according to the third embodiment of the present invention.

FIG. 14 is a time chart showing the operation of the cooling fan according to the third embodiment of the present invention. Similar to FIG. 10, the horizontal axis represents time t after the printing is completed, and the vertical axis represents the temperature Td of the fixing device 18. A solid line in FIG. 14 represents a temperature condition for accelerating the cooling fan, and a hidden line in FIG. 14 represents a temperature condition for decelerating the cooling fan. The fan acceleration temperature and the fan deceleration temperature are set in a way similar to those of the fan stop temperature and the fan resume temperature in the second embodiment shown in FIG. 10, and explanation thereof are omitted.

FIG. 15 is a table showing acceleration levels and deceleration levels of the cooling fan according to the third embodiment of the present invention. As shown in FIG. 15, the acceleration levels and deceleration levels of the cooling fan are set according to a time after the printing is completed, and are stored in a memory. For example, after the printing is completed, when the temperature Td of the fixing device 18 decreases below the fan deceleration temperature at a time between time t1 and time t2, the cooling fan is decelerated by two levels according to the number "2" corresponding to the time from time t1 to time t2 in the table.

A process of controlling the temperature Td of the fixing device 18 according to the fan acceleration temperature and the fan deceleration temperature will be explained next with reference to FIG. 14. When the printing is completed (timing t0), the print control unit 20 controls the temperature sensors 6*a* and 6*b* to detect the temperature Td of the fixing device 18. When the temperature Td of the fixing device 18 becomes below the fan deceleration temperature indicated by the solid line, the print control unit 20 decelerates a speed of the cooling fan 1 to a level set in the table shown in FIG. 15 according to the time. In the embodiment, the temperature Td of the fixing device 18 becomes below the fan deceleration temperature during the time between time t1 and time t2, thereby decelerating the speed by two levels.

When the temperature Td of the fixing device 18 becomes above the fan acceleration temperature indicated by the hidden line, the print control unit 20 accelerates the speed of the cooling fan 1. In the embodiment, the temperature Td of the fixing device 18 does not become above the fan acceleration temperature. Accordingly, the speed of the cooling fan is gradually decelerated to zero (off).

The steps described above are repeated from the completion of the printing (timing t0) to the maximum fan operating time tmax. Accordingly, as shown in FIG. 14, it is possible to maintain the temperature Td of the fixing device 18 within the range between the fan acceleration temperature and the fan deceleration temperature.

Figure 16:
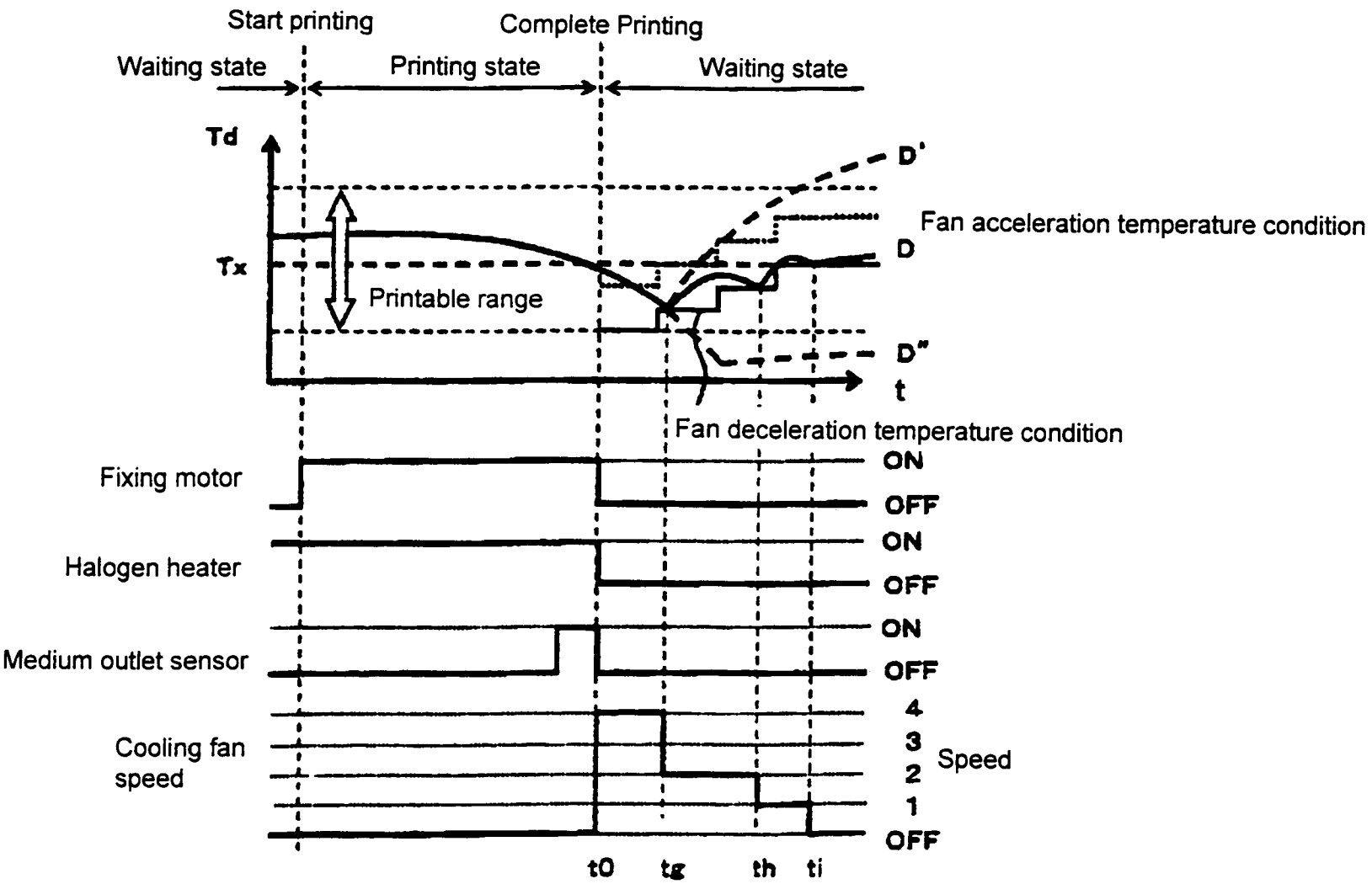
FIG. 16 is a time chart showing a process of controlling a temperature of a fixing device according to the third embodiment of the present invention.

FIG. 16 is a time chart showing another process of controlling the temperature Td of the fixing device 18 according to the third embodiment of the present invention. In this case, the fixing device 18 has a different heat capacity or a different number of sheets absorb heat.

As shown in FIG. 16, when the printing is completed (timing t0), the print control unit 20 sets the speed of the cooling fan 1 at the maximum level 4, and gradually deceases the speed of the cooling fan 1 at timing tg to timing ti. Accordingly, it is possible to smoothly control the temperature Td of the fixing device 18 along a solid line D, thereby securely maintaining the temperature Td within the printable temperature range.

With a conventional controlling method, when the fixing device 18 has a large heat capacity or a small number of sheets absorb a small amount of heat, the temperature of the fixing device may exceed the printable temperature range, thereby causing over-shoot indicated by a hidden line D'. Similarly, when the fixing device 18 has a small heat capacity or a large number of sheets absorb a large amount of heat, the temperature of the fixing device may decrease below the printable temperature range, thereby causing under-shoot indicated by a hidden line D". On the other hand, with the control process described above, the temperature Td of the fixing device 18 is maintained within the printable temperature range.

In the third embodiment, the speed of the cooling fan 1 is controlled at four levels. The number of the levels is not limited thereto, and may be larger or smaller than four. Also, the speed of the cooling fan may be switched along an approximation condition formed of a single straight line, a plurality of straight lines, or a curved line.

Figure 17:
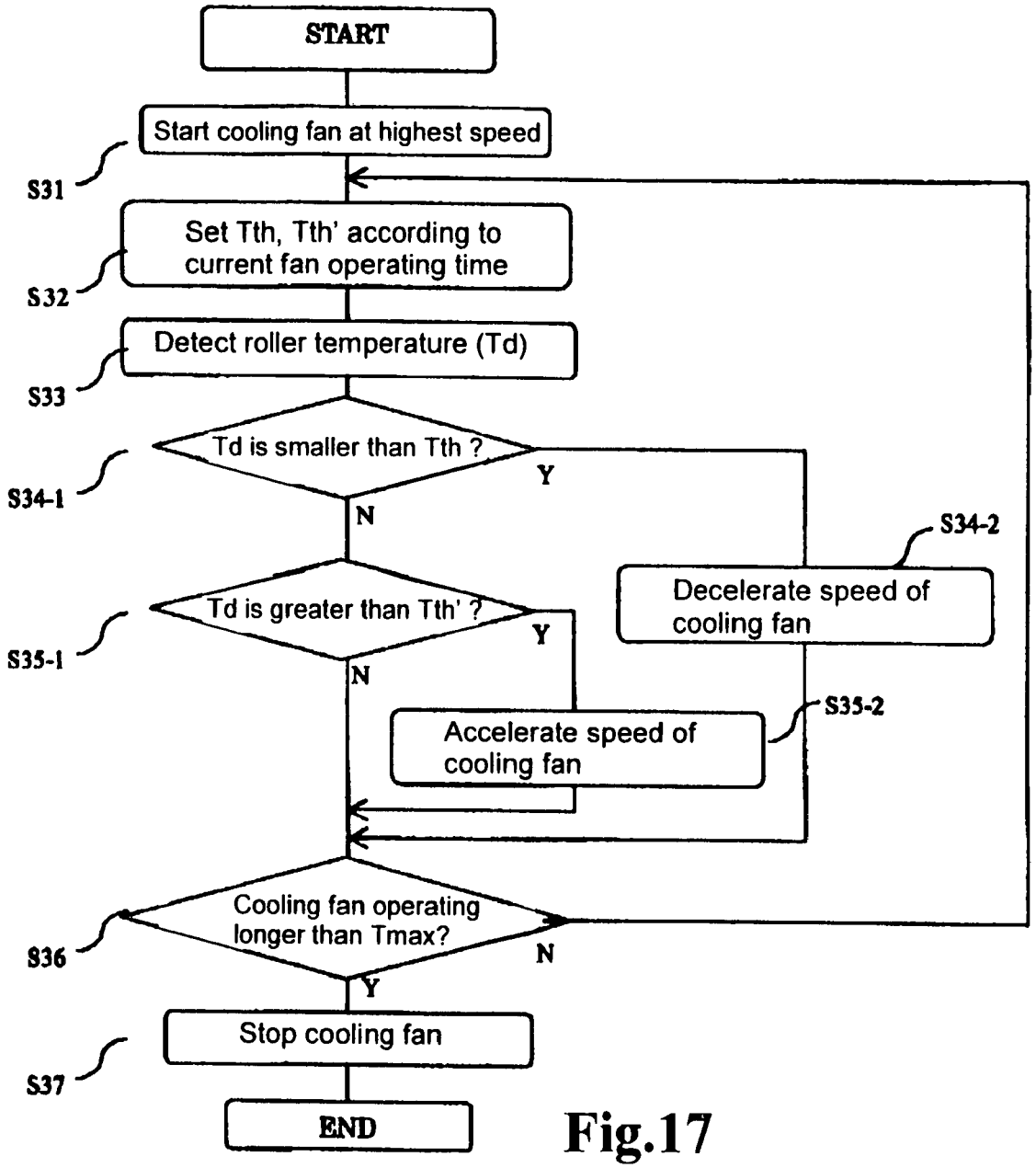
FIG. 17 is a flow chart showing a process of controlling the cooling fan according to the third embodiment of the present invention.

FIG. 17 is a flow chart showing the process of controlling the cooling fan according to the third embodiment of the present invention. In step S31, after the printing is completed, the print control unit 20 switches the fan ON signal 0 140 to a high level and the fan ON signals 1 141 to 3 143 at a low level, so that the cooling fan 1 rotates at the highest speed. In step S32, threshold temperatures Tth and Tth' are set at values corresponding to the fan acceleration temperature and the fan deceleration temperature, respectively, at the specific times after the cooling fan starts according to the fan acceleration and deceleration conditions shown in FIGS. 14 and 15. In this step, the specific time is set similarly to the first embodiment.

In step S33, the print control unit 20 detects the temperature Td of the fixing device 18. In step S34-1, the print control unit 20 compares the temperature Td with the threshold temperature Tth. When the temperature Td is smaller than the threshold temperature Tth, the print control unit 20 decelerates the cooling fan 1 (S34-2). In a case that the cooling fan 1 is decelerated by two levels from the highest speed (time between time t1 and time t2), the print control unit 20 switches the fan ON signal 0 140 to a low level, and the fan ON siganl 2 142 to a high level. Then, the process proceeds to step S36. When the temperature Td is greater than the threshold temperature Tth, the process proceeds to step S35-1.

In step S35-1, the print control unit 20 compares the temperature Td with the threshold temperature Tth'. When the temperature Td is greater than the threshold temperature Tth', the print control unit 20 accelerates the cooling fan 1 (S35-2). In a case that the cooling fan 1 is accelerated by two levels from the lowest speed (time between time t1 and time t2), the print control unit 20 switches the fan ON signal 3 143 to a low level, and the fan ON signal 1 141 to a high level. Then, the process proceeds to step S36. When the temperature Td is smaller than the threshold temperature Tth', the process proceeds to step S36.

In step S36, it is determined that the maximum fan operating time tmax is passed. When the maximum fan operating time tmax is passed, the print control unit 20 stops the cooling fan 1 (S37). When the maximum fan operating time tmax is not passed, the process returns to step S32.

As described above, in the image forming apparatus of the third embodiment, the fan acceleration temperature and the fan deceleration temperature are set according to the specific time after the printing is completed. When the temperature of the fixing device becomes below the fan deceleration temperature, the cooling fan is decelerated. When the temperature of the fixing device becomes above the fan acceleration temperature, the cooling fan is accelerated. Accordingly, the cooling fan is controlled through the speed thereof, not the on-off control in the first and second embodiments, it is possible to smoothly control the cooling fan. Further, it is possible to securely maintain the temperature of the fixing device within the printable temperature range, thereby reducing the waiting time for the next printing operation.

MODIFICATIONS

According to the present invention, the following modifications are applicable.

In the embodiments, the cooling fan 1 is controlled through the on-off control or the speed according to the temperature Td of the fixing device 18. Alternatively, a distance between the cooling fan 1 and the fixing device 18 may be controlled. Further, a plurality of cooling fans is provided, and each of the cooling fans is controlled through the on-off control or the speed, or both.

In the image forming apparatus described above, an influence of a temperature inside the printing unit or a temperature and humidity around the fixing device is not considered. It is conceivable that when the temperature inside the printing unit or the temperature and humidity around the fixing device increases, it is difficult to cool the fixing device. Accordingly, it is possible to change the fan stop temperature, the fan resume temperature, the fan acceleration temperature, or the fan deceleration temperature by a specific value according to a detected value of the temperature and humidity sensor 17.

In the embodiments, the specific time $\Delta t$ or the specific temperature $\Delta Td$ has a constant value. Alternatively, the specific time $\Delta t$ may be changed gradually, and the specific temperature $\Delta Td$ is changed accordingly. Also, the specific time $\Delta t$ or the specific temperature $\Delta Td$ may be changed according to the temperature of the fixing device 18. Further, the fan stop condition may be expressed by a function of time t having a single straight line, a plurality of straight lines, or a curved line.

For example, the fan stop condition may be expressed by an equation of $\{(Tx-T0)/tmax\}\cdot t+T0$, wherein T0 is the lower limit temperature of the printable temperature range, Tx is the target temperature, and tmax is the maximum fan operating time. After the printing is completed, the fan stop condition is determined through the equation according to time t. When the temperature of the fixing device 18 becomes below the calculated temperature, the cooling fan is stopped. In the case of the second or third embodiment, the fan stop temperature, the fan resume temperature, the fan acceleration temperature, or the fan deceleration temperature may be expressed by a function of time t having a single straight line, or a curved line. The fan stop temperature, the fan resume temperature, the fan acceleration temperature, or the fan deceleration temperature is determined through an equation, and compared with the temperature of the fixing device 18.

In the embodiments, the print completion upon which the cooling fan 1 starts is not specifically explained. The print completion may be when one page is completely printed, or one document file is completely printed. Alternatively, when an information processing device does not send print data for a specific period of time after the printing, the control of the temperature of the fixing device 18 may start. The cooling fan may start whether or not the printing is completed.

The disclosure of Japanese Patent Application No. 2004-361950, filed on Dec. 14, 2004, is incorporated in the application.

While the invention has been explained with reference to the specific embodiments of the invention, the explanation is illustrative and the invention is limited only by the appended claims.

What is claimed is:

1. An image forming apparatus for printing on a recording medium, comprising:

a fixing device for fixing developer on the recording medium;

a heating device for heating the fixing device;

a cooling device for cooling the fixing device;

a temperature detecting device for detecting a temperature of the fixing device;

a heating device control unit for controlling the heating device; and a cooling device control unit for controlling the cooling device, said cooling device control unit starting the cooling device when a series of printing operations is completed normally, said cooling device control unit reducing cooling effect of the cooling device when the temperature detecting device detects the temperature of the fixing device below a first temperature.

2. The image forming apparatus according to claim 1, wherein said cooling device includes a cooling fan, said cooling device control unit starting the cooling fan when a series of the printing operations is completed normally, said cooling device control unit stopping the cooling fan when the temperature detecting device detects the temperature of the fixing device below the first temperature.

3. The image forming apparatus according to claim 2, wherein said cooling device control unit starts the cooling fan when the temperature detecting device detects the temperature of the fixing device above a second temperature after the cooling fan is stopped.

4. The image forming apparatus according to claim 3, wherein said cooling device control unit repeats stopping and starting the cooling fan according to the temperature of the fixing device between the first temperature and the second temperature.

5. The image forming apparatus according to claim 2, wherein said cooling device control unit stops the cooling fan when the temperature detecting device detects the temperature of the fixing device below the first temperature according to an amount of time after a series of the printing operations is completed normally.

6. The image forming apparatus according to claim 2, wherein said cooling device control unit stops the cooling fan when the temperature detecting device detects the temperature of the fixing device below the first temperature changing by a first specific value according to an amount of time after a series of the printing operations is completed normally.

7. The image forming apparatus according to claim 3, wherein said cooling device control unit starts the cooling fan when the temperature detecting device detects the temperature of the fixing device above the second temperature including a plurality of temperatures according to an amount of time after a series of the printing operations is completed normally.

8. The image forming apparatus according to claim 3, wherein said cooling device control unit starts the cooling fan when the temperature detecting device detects the temperature of the fixing device above the second temperature changing by a second specific value according to an amount of time after a series of the printing operations is completed normally.

9. The image forming apparatus according to claim 3, wherein said fixing device fixes the developer on the recording medium when the temperature of the fixing device is within a printable temperature range, said cooling device control unit stopping the cooling fan when the temperature detecting device detects the temperature of the fixing device below the first temperature equal to or greater than a lower limit of the printable temperature range, said cooling device control unit starting the cooling fan when the temperature detecting device detects the temperature of the fixing device above the second temperature greater than the first temperature and equal to or smaller than an upper limit of the printable temperature range.

10. The image forming apparatus according to claim 1, wherein said cooling device includes a cooling fan, said cooling device control unit starting the cooling fan when a series of the printing operations is completed normally, said cooling device control unit reducing a speed of the cooling fan when the temperature detecting device detects the temperature of the fixing device below the first temperature.

11. The image forming apparatus according to claim 10, wherein said cooling device control unit increases the speed of the cooling fan when the temperature detecting device detects the temperature of the fixing device above a second temperature after the speed of the cooling fan is reduced.

12. The image forming apparatus according to claim 11, wherein said cooling device control unit repeats reducing and increasing the speed of the cooling fan according to the temperature of the fixing device between the first temperature and the second temperature.

13. The image forming apparatus according to claim 1, wherein said fixing device fixes the developer on the recording medium when the temperature of the fixing device is within a printable temperature range, said cooling device control unit reducing the cooling effect of the cooling device when the temperature detecting device detects the temperature of the fixing device below the first temperature equal to or greater than a lower limit of the printable temperature range.

14. The image forming apparatus according to claim 1, wherein said temperature detecting device is provided for maintaining the temperature of the fixing device within a specific temperature suitable for a fixing operation, said heating device control unit controlling the heating device so that the temperature of the fixing device is maintained within the specific temperature.

15. The image forming apparatus according to claim 1, further comprising a fixing motor, said cooling device control unit starts the cooling device when a series of the printing operations is completed normally and the fixing motor is stopped.

16. An image forming apparatus for printing on a recording medium, comprising:

a fixing device for fixing developer on the recording medium;

a heating devide for heating the fixing device;

a cooling device for cooling the fixing device;

a temperature detecting device for detecting a temperature of the fixing device;

a heating device control unit for controlling the heating device; and a cooling device control unit for controlling the cooling device, said cooling device control unit starting the cooling device when a series of printing operations is completed normally, said cooling device control unit decelerating the cooling device when the temperature detecting device detects the temperature of the fixing device below a first temperature, said cooling device control unit accelerating the cooling device when the temperature detecting device detects the temperature of the fixing device above a second temperature.

17. The image forming apparatus according to claim 16, wherein said cooling device control unit repeats decelerating and accelerating the drive of the cooling device according to the temperature of the fixing device between the first temperature and the second temperature.

18. The image forming apparatus according to claim 16, wherein said cooling device control unit decelerates the cooling device when the temperature detecting device detects the temperature of the fixing device below the first temperature according to an amount of time after a series of the printing operations is completed normally.

19. The image forming apparatus according to claim 16, wherein said cooling device control unit accelerates the cooling device when the temperature detecting device detects the temperature of the fixing device above the second temperature according to an amount of time after a series of the printing operations is completed normally.

20. The image forming apparatus according to claim 16, wherein said cooling device control unit decelerates the cooling device when the temperature detecting device detects the temperature of the fixing device below the first temperature changing by a first specific value according to an amount of time after a series of the printing operations is completed normally, said cooling device control unit accelerating the cooling device when the temperature detecting device detects the temperature of the fixing device above the second temperature changing by a second specific value according to the amount of time after a series of the printing operations is completed normally.

21. The image forming apparatus according to claim 16, wherein said fixing device fixes the developer on the recording medium when the temperature of the fixing device is within a printable temperature range, said cooling device control unit decelerating the drive of the cooling device when the temperature detecting device detects the temperature of the fixing device below the first temperature equal to or greater than a lower limit of the printable temperature range, said cooling device control unit accelerating the drive of the cooling device when the temperature detecting device detects the temperature of the fixing device above the second temperature greater than the first temperature and equal to or smaller than an upper limit of the printable temperature range.

22. The image forming apparatus according to claim 16, wherein said temperature detecting device is provided for maintaining the temperature of the fixing device within a specific temperature suitable for a fixing operation, said heating device control unit controlling the heating device so that the temperature of the fixing device is maintained within the specific temperature.

23. The image forming apparatus according to claim 16, further comprising a fixing motor, said cooling device control unit starts the cooling device when a series of the printing operations is completed normally and the fixing motor is stopped.

24. An image forming apparatus for printing on a recording medium, comprising:

a fixing device for fixing developer on the recording medium;

a heating device for heating the fixing device;

a cooling device for cooling the fixing device;

a temperature detecting device for detecting a temperature of the fixing device;

a heating device control unit for controlling the heating device; and a cooling device control unit for controlling the cooling device, said cooling device control unit starting the cooling device after the fixing device fixes the developer on the recording medium, said cooling device control unit reducing cooling effect of the cooling device when the temperature detecting device detects the temperature of the fixing device below a first temperature according to an amount of time after the fixing device fixes the developer on the recording medium.

* * * * *